US007320146B2

(12) United States Patent
Nortier et al.

(10) Patent No.: US 7,320,146 B2
(45) Date of Patent: Jan. 22, 2008

(54) SENSOR PLATE FOR ELECTRONIC FLUSHOMETER

(75) Inventors: Richard A. Nortier, Westchester, IL (US); Steven R. Oliver, Chicago, IL (US)

(73) Assignee: Sloan Valve Company, Franklin Park, IL (US)

( * ) Notice: Subject to any disclaimer, the term of this patent is extended or adjusted under 35 U.S.C. 154(b) by 165 days.

(21) Appl. No.: 11/127,538

(22) Filed: May 12, 2005

(65) Prior Publication Data

US 2006/0255301 A1 Nov. 16, 2006

(51) Int. Cl.
*F16K 31/02* (2006.01)

(52) U.S. Cl. ..... 4/304; 4/623; 200/343; 251/129.03; 251/231

(58) Field of Classification Search ..... 251/129.3, 251/129.15, 129.03, 231; 200/343, 339; 4/302, 304, 305, 313, 623
See application file for complete search history.

(56) References Cited

U.S. PATENT DOCUMENTS

| | | | | |
|---|---|---|---|---|
| 3,233,071 | A | 2/1966 | Buzzell | |
| 3,325,618 | A * | 6/1967 | Sullivan | 200/343 |
| 3,593,073 | A | 7/1971 | Atkins | |
| 3,731,025 | A | 5/1973 | Filliung | |
| 3,800,104 | A * | 3/1974 | Lien et al. | 200/343 |
| 4,136,270 | A * | 1/1979 | Wernet et al. | 200/343 |
| 4,172,217 | A | 10/1979 | Miller | |
| 4,203,173 | A | 5/1980 | Morris et al. | |
| 4,309,781 | A | 1/1982 | Lissau | |
| 4,387,282 | A | 6/1983 | Latasiewiecc | |
| 4,692,951 | A * | 9/1987 | Taki et al. | 4/213 |
| 4,713,509 | A | 12/1987 | Chebownski | |
| 5,087,802 | A * | 2/1992 | Guilleminot | 200/343 |
| 5,224,509 | A | 7/1993 | Tanaka et al. | |
| 5,313,673 | A * | 5/1994 | Saadi et al. | 4/313 |
| 5,495,626 | A | 3/1996 | Lindroos et al. | |
| 5,723,833 | A | 3/1998 | Thrasher | |
| 5,819,913 | A | 10/1998 | Reiter | |
| 5,898,141 | A | 4/1999 | Blalock et al. | |
| 5,941,372 | A | 8/1999 | Johnston | |
| 5,983,414 | A | 11/1999 | Lindroos et al. | |
| 6,031,196 | A | 2/2000 | Johnston | |
| 6,201,202 | B1 * | 3/2001 | Katagiri | 200/343 |
| 6,237,165 | B1 | 5/2001 | Chen et al. | |
| 6,479,772 | B2 | 11/2002 | Fan | |
| 6,616,118 | B2 | 9/2003 | Nortier | |
| 6,689,973 | B2 * | 2/2004 | Meagher et al. | 200/341 |
| 6,940,030 | B2 * | 9/2005 | Takeda et al. | 200/343 |
| 2004/0195082 | A1 | 10/2004 | Takeda et al. | |

* cited by examiner

*Primary Examiner*—John Bastianelli
(74) *Attorney, Agent, or Firm*—Foley & Lardner LLP

(57) ABSTRACT

An manual activation mechanism for an electronic flushometer system. A manual activation or override plate has a sensor switch directly coupled thereto and is hingedly connected to a sensor bracket. When a user presses the manual activation or override plate, the sensor switch acts against a bumper, which is compressed to create an electrical contact with a printed circuit board. The electrical contact results in the transmission of an electrical signal to a solenoid system, actuating a flushometer valve.

16 Claims, 6 Drawing Sheets

SENSOR PLATE FOR ELECTRONIC FLUSHOMETER

FIELD OF THE INVENTION

The present invention relates generally to electronic flushometer valves. More particularly, the present invention relates to sensor plates including manual override mechanisms for use with electronic flushometer valves.

BACKGROUND OF THE INVENTION

In the past several years, a number of different types of flushometer valve systems have been introduced into the marketplace. Many of these flushometer systems, while including an infrared or similar automatic detection mechanism, also include an electronic manual override, push button system by which a user can manually actuate the flushometer in the event that additional actuations are desired by the user.

Most conventional push buttons in flushometer systems are relatively small in size, often are not visible or obvious to a user, and require a significant amount of dexterity on the user's part in order to be actuated. In many instances, this requires that a person use his or her index finger in order to actuate the button. Because of this relative difficulty, many people do not use the push button systems, even if the automated mechanism is not actuated after use. Additionally, flushometer systems with manual override mechanism are also frequently installed in areas for persons with disabilities, and such people may have significant difficulty in actuation of such a relatively small push button.

All of the above problems are also sometimes compounded due to the location of such manual override buttons. In many instances, the push button is in close proximity to the flushometer valve and related components, potentially blocking access to the button. Lastly, conventional push button systems also often require a relatively high degree of force for activation, which can make actuation difficult for handicapped persons.

Many of the conventional systems discussed above require a relatively small push button due to the positioning of the sensor switch in the devices. In these systems, the sensor switch is not directly attached to the outside cover plate. As a result, actuation of certain portions of the cover plate will not have any effect upon the sensor switch, and therefore the flushometer may not be manually actuable if the wrong portion of the plate is pressed.

It would therefore be desirable to provide an improved manual activation mechanism that addresses the above-identified shortcomings, providing users with a larger activation area and also provide reliable actuation wherever depressed such that the device can be used by a wide variety of people with little difficulty, while also providing for simple installation and assembly.

SUMMARY OF THE INVENTION

The present invention provides for an improved push button system for actuating a flushometer valve. When a user desires to actuate the flushometer system, he or she presses an override plate to which a sensor switch is directly coupled. The override plate is hingedly connected to a sensor bracket. The movement of the override plate relative to the sensor bracket urges the sensor switch against a bumper, which causes an electrical signal to be transmitted to a solenoid system which actuates the flushometer.

With the present invention, the user is provided with a relatively large area for actuating the switch. In contrast to conventional flushometer systems, the direct coupling of the sensor switch to the override plate permits the user to press virtually any region on the override plate in order to manually actuate the flushometer. The present invention also results in a reduced amount of button travel and is aesthetically superior to a conventional system that requires visible attachment fasteners. Furthermore, the sensor switch and the electrical connections are all shielded from direct water contact. A system incorporating the present invention is easy to install and can also compensate for minor rough-in errors. The present invention can be incorporated into a wide variety of flushometer systems, including both closet and urinal systems that may or may not have an associated automated sensing mechanism.

These and other objects, advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF THE PREFERRED EMBODIMENTS

Figure 1:
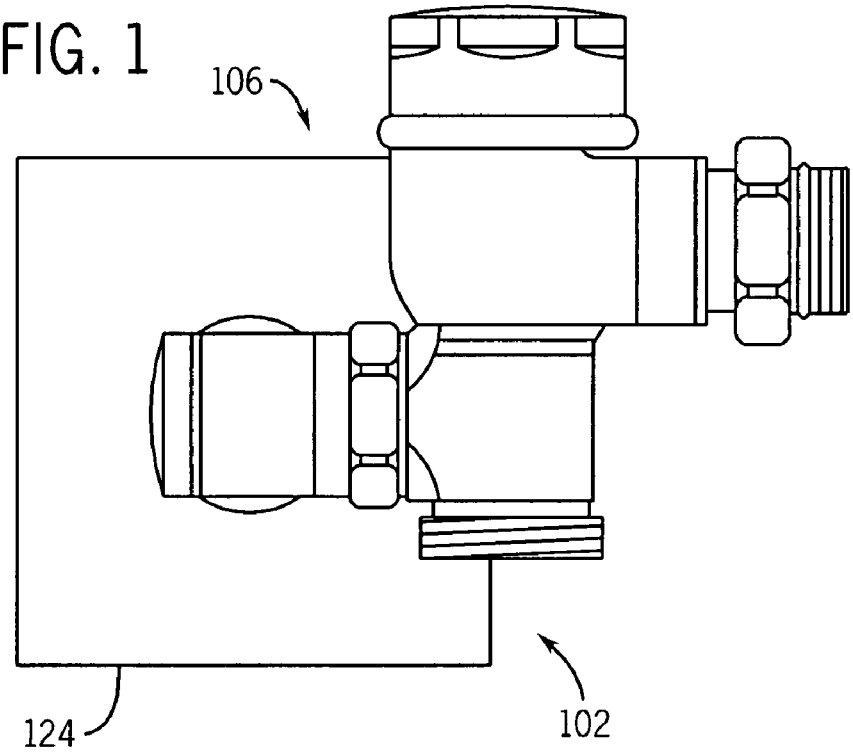
FIG. 1 is a front end view of a base portion of a closet flushometer system according to one embodiment of the present invention.
Figure 2:
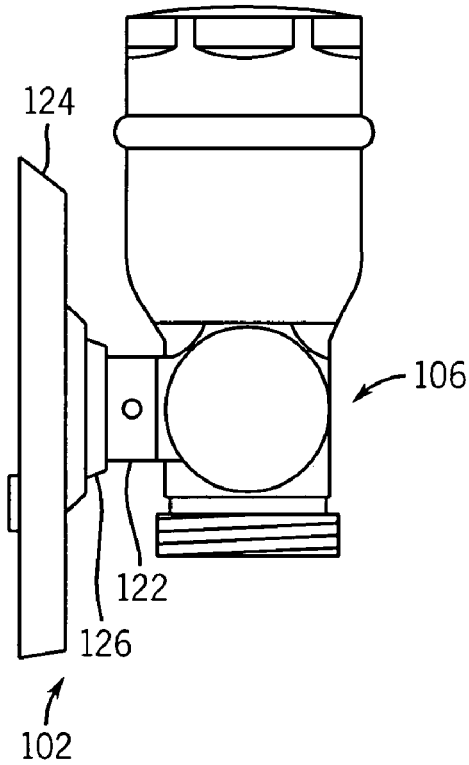
FIG. 2 is a side view of the base portion of the closet flushometer system of FIG. 1.
Figure 3:
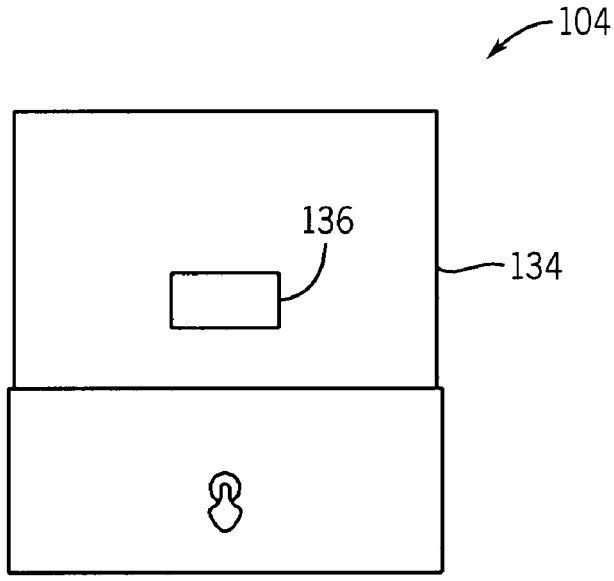
FIG. 3 is a front view of a sensor and override plate of the closet flushometer system.
Figure 5:
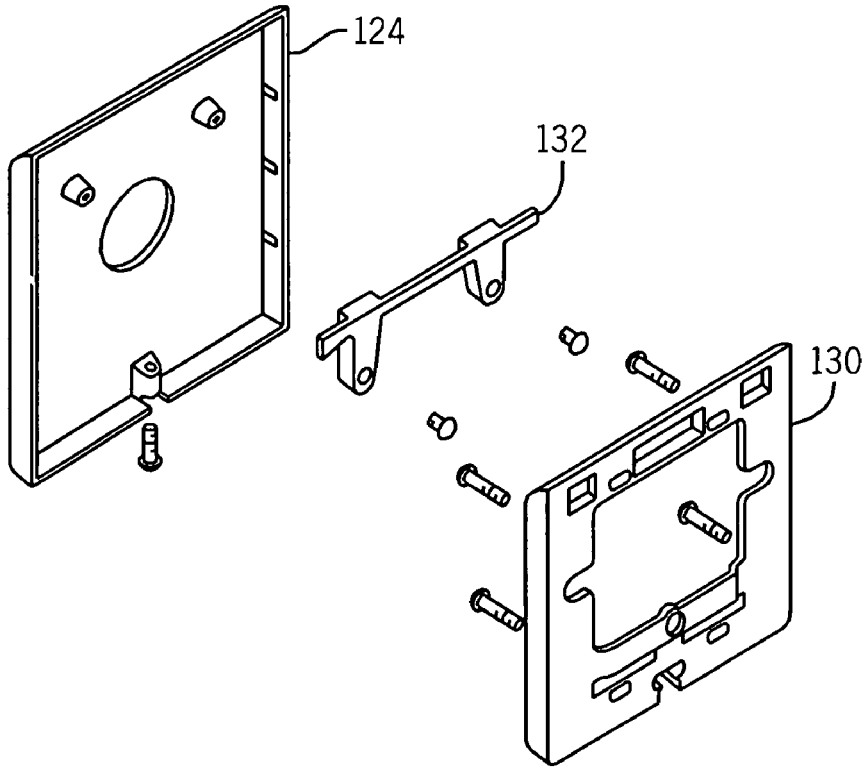
FIG. 5 is an exploded front isometric view of the cover plate, mounting plate and wall plate bracket for the closet flushometer system.
Figure 4:
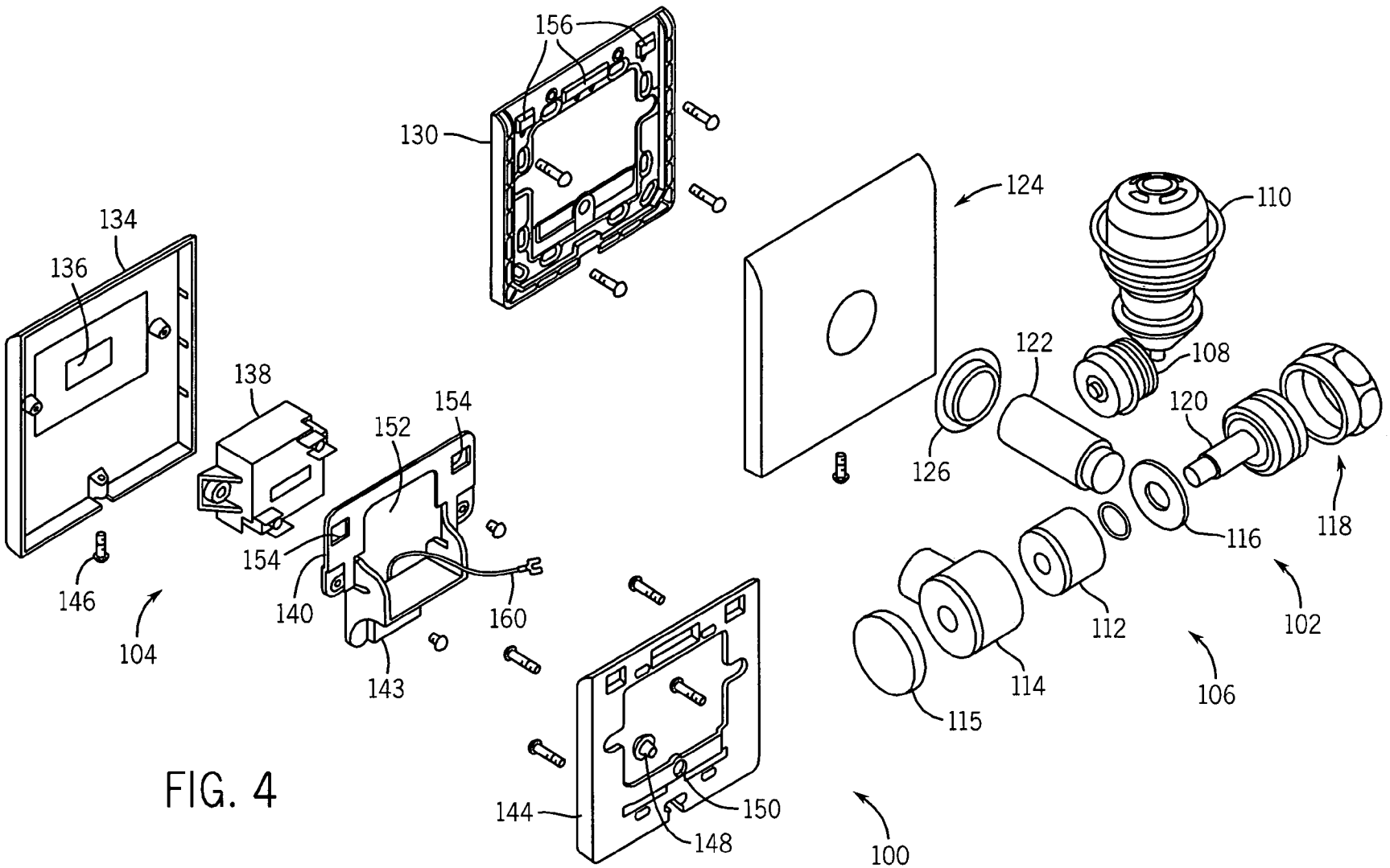
FIG. 4 is an exploded rear isometric view of the closet flushometer system.

FIGS. 1-10 show various aspects of a closet flushometer system 100 constructed according to one embodiment of the present invention. As shown in FIGS. 1-3, the closet flushometer system 100 includes a base portion 102 and a sensor portion 104. As shown in FIG. 4, The base portion 102 includes a solenoid system 106 coupled to a cartridge assembly 108, which in turn leads to a flushometer water supply unit 110. The solenoid system 106 comprises a coil 112 positioned within a solenoid housing 114, to which is coupled an end retaining nut 115. A washer 116 is positioned between the solenoid housing 114 and a solenoid coupling 118. The washer 116 is positioned around a solenoid shaft 120, which is also positioned between the solenoid housing 114 and the solenoid coupling 118. The solenoid housing 114 of the solenoid assembly 106 is coupled to a nipple assembly 122, which connects to a cover plate 124 via a flange assembly 126. Electrical wires (not shown) for actuating and deactuating the solenoid assembly 106 are housed within the nipple assembly 122. The cover plate 124 is coupled to an electrical transformer or supply (not shown) within a wall via a mounting plate 130 and a wall plate bracket 132 (see FIG. 5).

As shown in FIG. 4, positioned above the cover plate 124 and associated components is a actuator cover plate 134. The actuator cover plate 134 includes a sensor window 136, behind which is positioned an infrared automatic sensor switch 138. The infrared automatic sensor switch 138 is housed within a sensor bracket 140. A plurality of sensor contact wires (not shown) are used to electrically connect the automatic sensor switch 138 to the remainder of the flushometer system 100.

The sensor bracket 140 also includes a manual sensor switch 143 on a bottom portion thereof. A plurality of wires 160 lead from the manual sensor switch 143 to the solenoid assembly 106 and electrical supply. A sensor mounting plate 144 is coupled at a bottom portion thereof to the actuator cover plate 134 by a mounting screw 146. This coupling is only used for retaining purposes. The sensor mounting plate 144 is also coupled to the wall on the side opposite the actuator cover plate 134.

Figure 10:
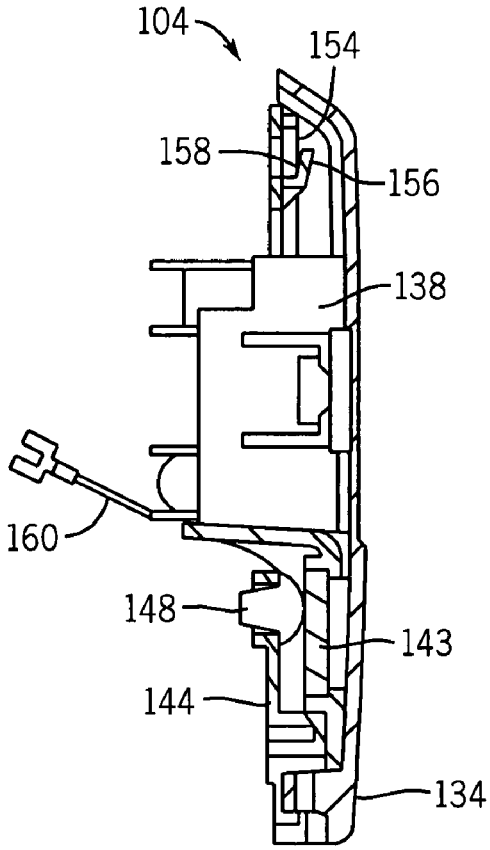
FIG. 10 is a sectional side view of an assembled sensor portion of the closet flushometer system.

The sensor mounting plate 144 also houses a bumper 148 within a receiving region 150 in a bottom portion thereof. The bumper 148 is positioned to come into selective contact with the manual sensor switch 143 which is movable between a first position and a second position. When in the first position (at rest), the bumper 148 is in slight contact with the manual sensor switch 143, as shown in FIG. 10.

Figure 6:
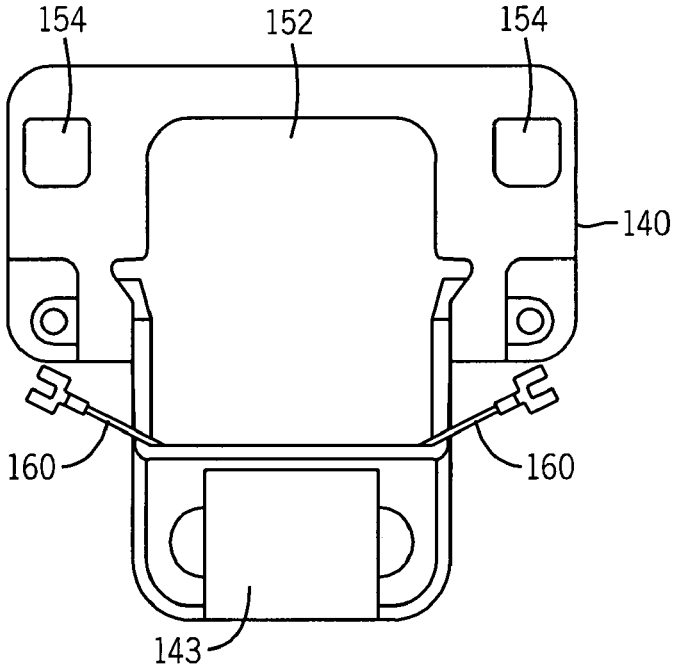
FIG. 6 a rear end view of the sensor bracket of the closet flushometer system.
Figure 8:
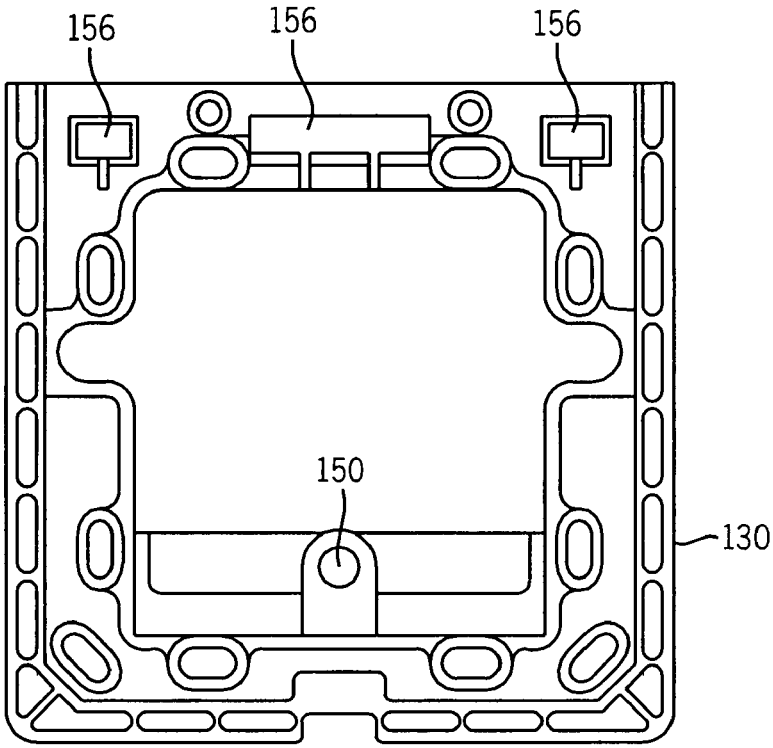
FIG. 8 is a front view of the sensor mounting plate of FIG. 7.
Figure 7:
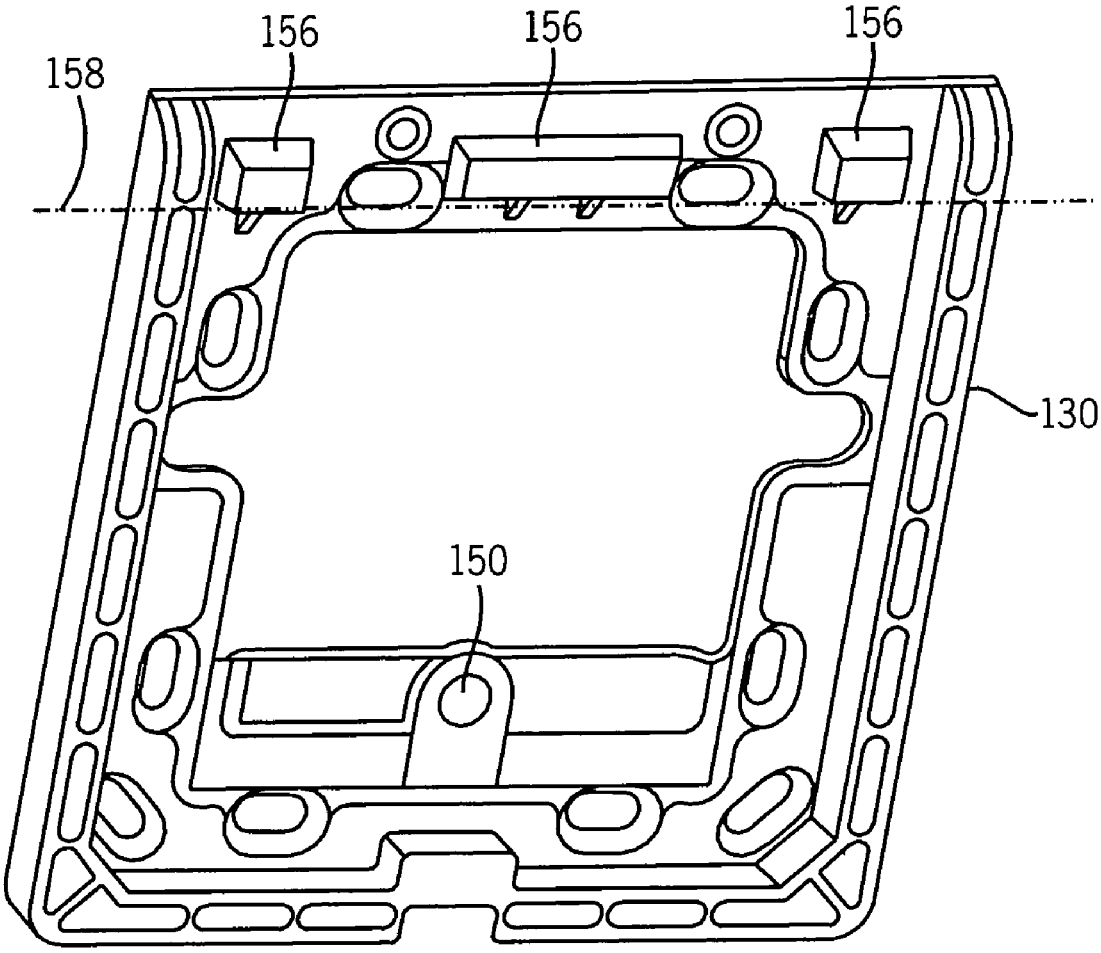
FIG. 7 is a isometric view of the sensor mounting plate of the closet flushometer system.
Figure 9:
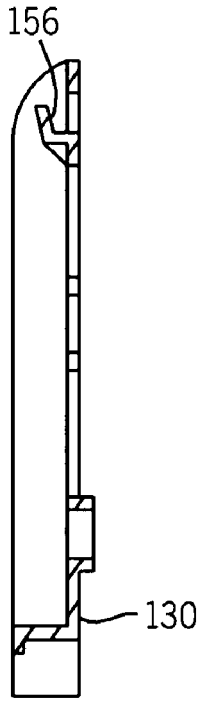
FIG. 9 is a sectional side view the assembled sensor portion according to one embodiment of the present invention.

FIG. 6 is a rear end view of the sensor bracket 140 of the closet flushometer system 100. The sensor bracket 140 includes a primary opening 152 and a pair of secondary openings 154. The primary opening 152 and the secondary openings 154 are used to mate the sensor bracket 140 with the sensor mounting plate 144 (see FIG. 4). As shown in FIGS. 7-10, the sensor mounting plate 144 includes a plurality of hooks 156. The plurality of hooks 156 are selectively positioned to mate with the primary opening 152 and the plurality of secondary openings 154, with the mating resulting in a secure but rotatable fit between the sensor bracket 140 with the sensor mounting plate 144 about a hinge 158 (as represented in FIG. 7).

As best seen in FIG. 4, The automatic sensor switch 138 is securely fastened to the actuator cover plate 134 and rests within the primary opening 152 of the sensor bracket 140. Rotatable movement of the actuator cover plate 134 relative to the sensor mounting plate 144 about the hinge 158 therefore results in a corresponding movement in the manual sensor switch 143, which is securely connected to the sensor bracket 140.

In one embodiment of the invention, the automatic sensor switch 138 comprises an infrared detection mechanism. The infrared detection mechanism is used to detect when an individual is no longer using the toilet associated with the closet flushometer system 100. However, it should be noted that the present invention can also be used without an infrared detection mechanism. When a user steps away from the closet flushometer system 100 including an infrared sensor mechanism, the automatic sensor switch 138 transmits an electrical signal to the coil 112 of the solenoid system 106. The energizing of the coil 112 causes a solenoid pole piece (not shown) to move within the solenoid shaft 120, opening the valve and permitting water to be released for flushing. The infrared sensor mechanism can also monitor when an individual enters the effective range of the mechanism. This information can be used to help prevent false flushing of the system.

The operation of an override according to the present invention is generally as follows. As shown in FIG. 3, when a user wishes to override an automated flushing mechanism such as an infrared sensor, he or she presses the actuator cover plate 134. As depicted in FIG. 10, both the actuator cover plate 134 and the sensor bracket 140 rotate about the hinge 158, causing the manual sensor switch 143 to act against the bumper 148. This action causes an electrical signal to be transmitted to the solenoid system 106, opening the flushometer valve and initiating the flushing process. In one embodiment of the present invention, a manual sensor switch movement of only 0.012 inches is needed for an electrical signal to be transmitted to the solenoid assembly 106.

By creating the hinge 158 between the sensor bracket 140 and the sensor mounting plate 144, the user can create the necessary contact by pushing virtually any portion of the actuator cover plate 134, meaning that the user could potentially use his or her open hand, finger, elbow, or other item such as a cane to cause the actuation. This is in contrast to conventional systems, where a user must press a very specific portion of a plate or push button to cause the actuation.

The present invention as discussed herein can be incorporated into a wide variety of flushometer systems. For example, but without limitation, the manual actuation system of the present invention can be incorporated into electronic flushometer systems that include virtually any type of automatic activation system, as well as flushometer systems that include no automatic activation mechanism at all. The present invention can be incorporated into both closet flushometer systems and urinal flushometer systems.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments and with various modifications as are suited to the particular use contemplated.

What is claimed is:

1. A manual actuation assembly for use in electronic flushometer system, comprising:

a manual actuation plate;

a sensor mounting bracket coupled to the manual actuation plate and including a manual sensor switch coupled directly thereto;

a sensor mounting plate hingedly connected to the sensor mounting bracket at one end thereof, the sensor mounting plate supporting a bumper positioned therein, wherein actuation of the manual actuation plate causes a pivoting movement of the manual sensor switch relative to the sensor mounting plate, the manual sensor switch acting against the bumper to create an electrical signal that is transmitted to actuate a flushometer valve.

2. The manual actuation assembly of claim 1, wherein the sensor mounting plate is hingedly connected to the sensor mounting bracket at a top portion thereof.

3. The manual actuation assembly of claim 2, wherein the sensor mounting plate includes a plurality of hooks at a top portion thereof, and wherein the plurality of hooks engage a plurality of openings in the sensor mounting brackets to create a hinge therebetween.

4. The manual actuation assembly of claim 1, further comprising an infrared sensor switch positioned within the sensor bracket and in electrical communication with the flushometer valve.

5. The manual actuation assembly of claim 1, wherein a bottom portion of the manual actuation plate is directly coupled to a bottom portion of the sensor mounting plate via a retaining fastener, restricting the movement of the manual actuation plate.

6. The manual actuation assembly of claim 1, wherein the sensor mounting plate is secured to a wall via a plurality of fasteners.

7. The manual actuation assembly of claim 1, wherein the flushometer valve comprises a solenoid valve assembly in selective electrical communication with the manual sensor switch.

8. An electronic flushometer valve system, comprising:

a manual actuation plate;

a sensor mounting bracket coupled to the manual actuation plate and including a manual sensor switch coupled directly thereto;

an automated sensor switch positioned within the sensor mounting bracket and in electrical communication with a solenoid valve, the automated sensor switch transmitting an electrical signal to actuate the solenoid valve in response to selected user movement to actuate the electronic flushometer valve system; and a sensor mounting plate hingedly connected to the sensor mounting bracket at one end thereof, the mounting plate supporting a bumper positioned therein, wherein actuation of the manual actuation plate causes a pivoting movement of the manual sensor switch relative to the sensor mounting plate, the manual sensor acting against the bumper to electrically actuate the solenoid valve.

9. The electronic flushometer valve system of claim 8, wherein the automated sensor switch comprises an infrared sensor.

10. The electronic flushometer valve system of claim 8, wherein the sensor mounting plate is hingedly connected to the sensor mounting bracket at a top portion thereof.

11. The electronic flushometer valve system of claim 8, wherein the sensor mounting plate includes a plurality of hooks at a top portion thereof, and wherein the plurality of hooks engage a plurality of openings in the sensor mounting brackets to create a hinge therebetween.

12. The electronic flushometer valve system of claim 8, wherein a bottom portion of the manual actuation plate is directly coupled to a bottom portion of the sensor mounting plate via a retaining fastener, restricting the movement of the manual actuation plate.

13. An electronic flushometer valve system, comprising:

a solenoid valve;

an infrared sensor switch in electrical communication with the solenoid valve, the infrared sensor configured to automatically actuate the solenoid valve;

a manual actuation plate;

a sensor mounting bracket coupled to the manual actuation plate and including a manual sensor switch coupled directly thereto; and a sensor mounting plate hingedly connected to the sensor mounting bracket at one end thereof, the sensor mounting plate supporting a bumper positioned therein, wherein actuation of the manual actuation plate causes the manual sensor switch to pivot relative to the sensor mounting plate, the manual sensor switch acting against the bumper to electrically actuate the solenoid valve.

14. The electronic flushometer valve system of claim 13, wherein the sensor mounting plate is hingedly connected to the sensor mounting bracket at a top portion thereof.

15. The electronic flushometer valve system of claim 14, wherein the sensor mounting plate includes a plurality of hooks at a top portion thereof, and wherein the plurality of hooks engage a plurality of openings in the sensor mounting brackets to create a hinge therebetween.

16. The electronic flushometer valve system of claim 14, wherein a bottom portion of the manual actuation plate is directly coupled to a bottom portion of the sensor mounting plate via a retaining fastener, restricting the movement of the manual actuation plate.

* * * * *